US008578550B2

(12) United States Patent
Conrad

(10) Patent No.: US 8,578,550 B2
(45) Date of Patent: Nov. 12, 2013

(54) DOMESTIC AIR TREATMENT APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 315 days.

(21) Appl. No.: 12/846,897

(22) Filed: Jul. 30, 2010

(65) Prior Publication Data

US 2011/0023260 A1 Feb. 3, 2011

(30) Foreign Application Priority Data

Jul. 30, 2009 (CA) ..... 2674757

(51) Int. Cl.
*A47L 5/00* (2006.01)

(52) U.S. Cl.
USPC ..... 15/300.1; 15/334; 15/335

(58) Field of Classification Search
USPC ..... 15/300.1, 334, 35, 350, 351
See application file for complete search history.

(56) References Cited

U.S. PATENT DOCUMENTS 5,411,150 A * 5/1995 Sigurdsson ..... 209/235
2007/0028413 A1* 2/2007 Fischer et al. ..... 15/334

* cited by examiner

*Primary Examiner* — William Gilbert
*Assistant Examiner* — Patrick Maestri
(74) *Attorney, Agent, or Firm* — Philip C. Mendes da Costa; Bereskin & Parr LLP/S.E.N.C.R.L., s.r.l.

(57) ABSTRACT

A domestic air treatment apparatus such as a vacuum cleaner comprises a fluid flow path including a dirt inlet and a clean air outlet. A suction motor and a treatment member are provided in the flow path. The fluid flow path comprises a portion that has a bend, such as an elbow, wherein all portions of the fluid flow path through the bend have a cross sectional area that is at least about the same as a cross sectional area of the inlet.

14 Claims, 5 Drawing Sheets

DOMESTIC AIR TREATMENT APPARATUS

FIELD

The specification relates to a domestic air treatment apparatus. Particularly, the specification relates to a domestic air treatment apparatus, such as a surface cleaning apparatus or an air cleaner that includes a fluid flow path comprising a bend.

INTRODUCTION

The following is not an admission that anything discussed below is prior art or part of the common general knowledge of persons skilled in the art.

A domestic air treatment apparatus, such as a vacuum cleaner, has a fluid flow path that extends from the dirt inlet of a surface cleaning head to a clean air outlet. Situated in the fluid flow path are a suction motor to draw air through the fluid flow path and one or more treatment members to remove entrained dirt from the air stream passing through the fluid flow path. Typically, the airflow path will comprise one or more bends, e.g., a 90° elbow, to redirect the air between different components of the vacuum cleaner. The dirty air that enters the dirt inlet will typically contain fluff, hair or other elongate material. This material has a tendency to clog the airflow path. Accordingly, one or more clean out ports may be provided.

SUMMARY

The following summary is provided to introduce the reader to the more detailed discussion to follow. The summary is not intended to limit or define the claims.

According to one broad aspect, a domestic air treatment apparatus is provided. The domestic air treatment apparatus comprises a fluid flow path including a dirt inlet and a clean air outlet. A suction motor and a treatment member are provided in the flow path. The fluid flow path comprises a portion that has a bend of at least 45°. The bend has a bend inlet having an inlet direction of flow, a bend outlet having an outlet direction of flow, and a curved outer wall. All portions of the fluid flow path through the bend have a cross sectional area that is at least about the same as a cross sectional area of the inlet.

Embodiments in accordance with this broad aspect may reduce, minimize, or prevent the occurrence of blockages or clogs within the bend. For example, known domestic air treatment apparatuses may comprise a fluid flow path that includes an elbow. The cross sectional area of the fluid flow path within the elbow is less than the cross sectional area at the inlet of the elbow. The redirection of flow produced by the elbow, together with a constriction of the airflow path through the elbow can lead to clogs or blockages within the elbow. By providing all portions of the fluid flow path through an elbow with a cross sectional area that is at least about the same as a cross sectional area of the inlet, the occurrence of clogs or blockages is reduced, prevented, or minimized. Accordingly, a clean out port need not be provided adjacent the elbow.

In any embodiment, the inlet direction of flow and the outlet direction of flow may be in the same plane. The outlet direction of flow may be at from 45° to 135°, preferably from about 70° to about 110° and more preferably about 90° to the inlet direction of flow.

In any embodiment, all portions of the fluid flow path through the bend may have a cross sectional area that is at least 90% of the cross sectional area of the inlet. Preferably, all portions of the fluid flow path through the bend may have a diameter that is about the same as and, more preferably, is greater than the diameter of the fluid flow path immediately upstream of the bend. Alternately, all portions of the fluid flow path through the bend may have a cross sectional area is the same as, and is preferably greater then the cross sectional area of the inlet.

In any embodiment, the bend may be constructed from at least a first part and a second part, wherein the first part comprises the bend inlet and the bend outlet and the second part comprises at least part of the curved outer wall.

In any embodiment, the bend may be an elbow. The elbow may have an inner side extending between the bend inlet and the bend outlet and an opposed outer side extending between the bend inlet and the bend outlet. The outer side may be longer than the inner side. At least a portion of the outer side may comprise a second part. The second part may be moveably mounted to the first part, and/or removeably mounted to the first part.

In any embodiment, the bend may be constructed from two parts. The bend may have a curved inner wall.

In any embodiment, the domestic air treatment apparatus may be a surface cleaning apparatus or an air cleaner.

DRAWINGS

Reference is made in the description to the following drawings, in which.

DESCRIPTION OF VARIOUS EMBODIMENTS

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Figure 1:
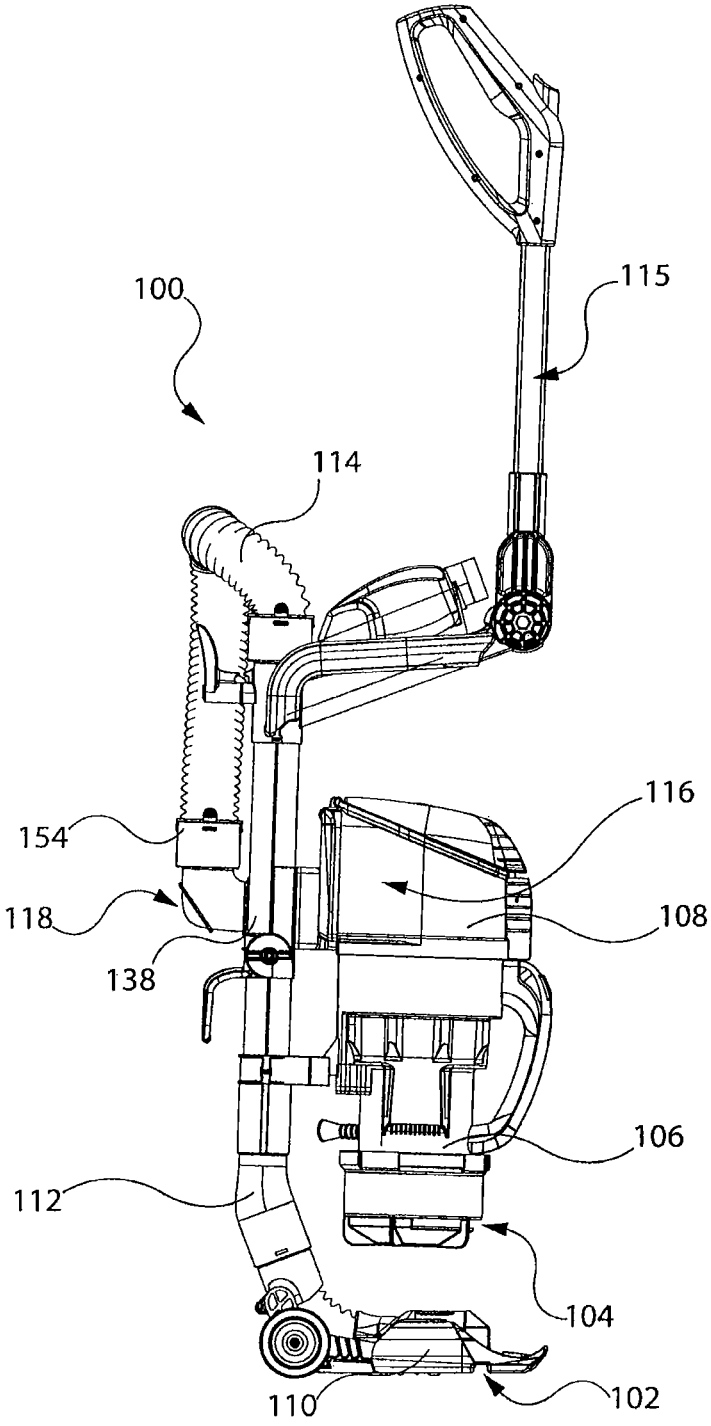
FIG. 1 is a perspective illustration of an exemplary surface cleaning apparatus comprising an embodiment of a bend.
Figure 2:
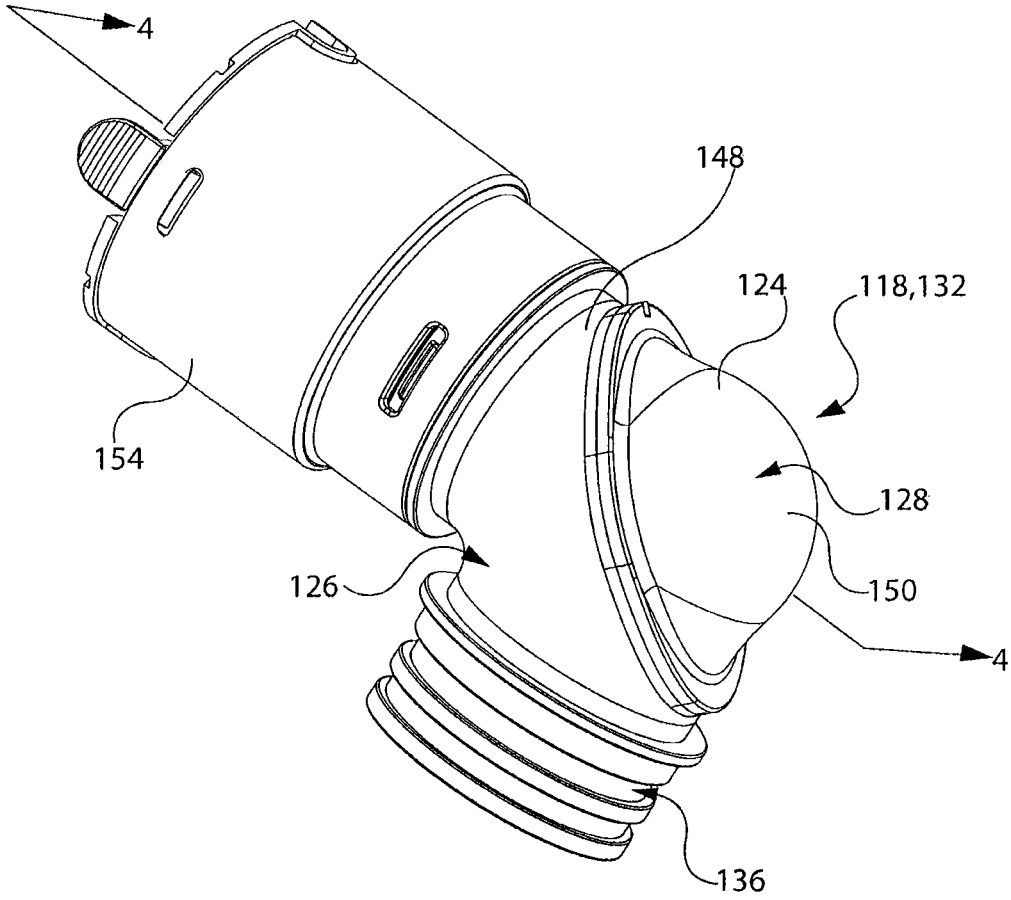
FIG. 2 is a perspective illustration of the bend of FIG. 1, mounted to a hose coupling.
Figure 3:
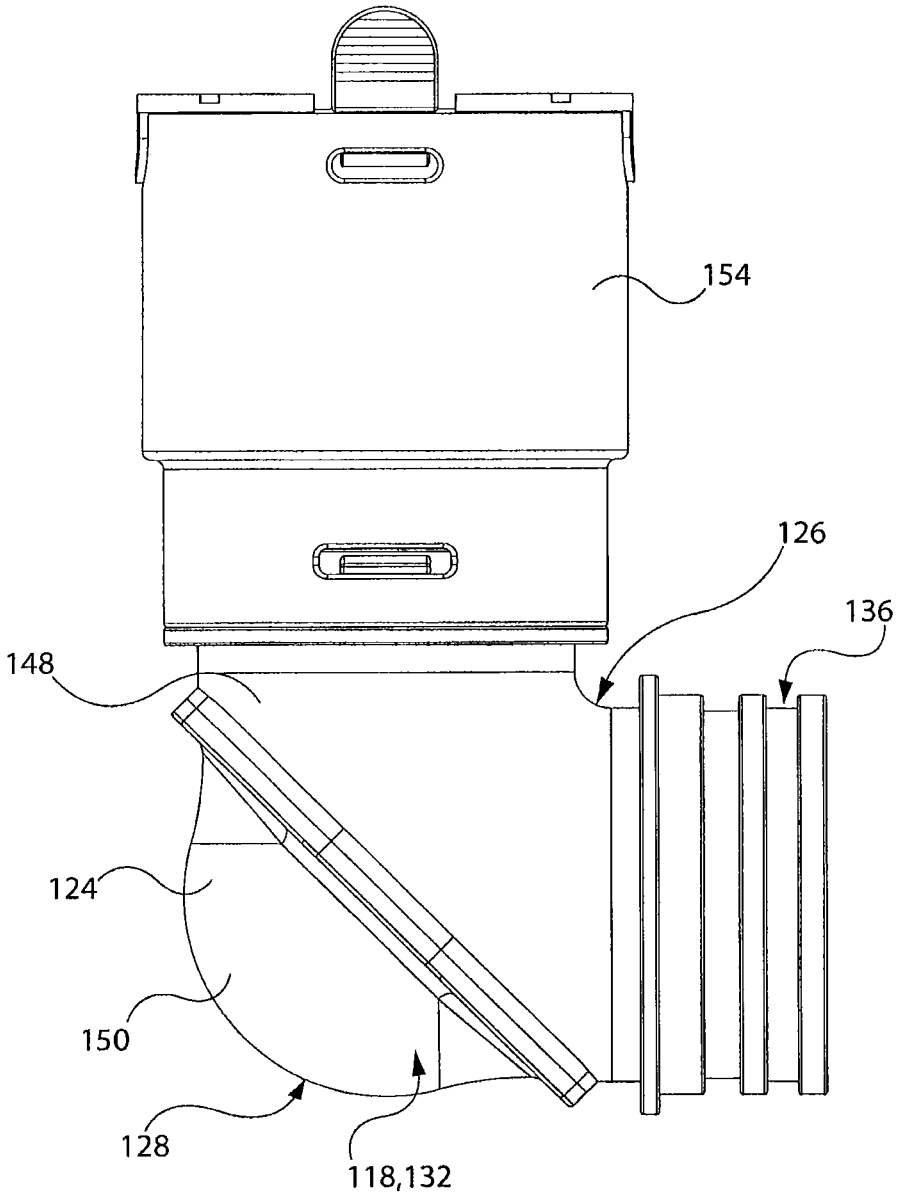
FIG. 3 is a side view of the bend and hose coupling of FIG. 2.

Referring to FIG. 1, a domestic air treatment apparatus 100 is shown. In the embodiment shown, the domestic air treatment apparatus 100 is a surface cleaning apparatus 100, and more particularly, an upright vacuum cleaner 100. In alternate embodiments, the surface cleaning apparatus may be, for example, a hand vacuum cleaner, a carpet extractor or cleaner, a canister type vacuum cleaner, a wet-dry vacuum cleaner, a central vacuum cleaner, or any other type of surface cleaning apparatus. In further alternate embodiments, the domestic air treatment apparatus may be, for example, an air cleaner.

Referring still to FIG. 1, in the embodiment shown, the surface cleaning apparatus 100 comprises a fluid flow path, which includes a dirt inlet 102 and a clean air outlet 104. A suction motor 106 and a treatment member 108 are provided in the fluid flow path. The treatment member may be any suitable member, which removes particulate matter from air, such as a filter bag and/or a cyclonic cleaning unit and/or one or more filters.

In the embodiment shown, the dirt inlet 102 is provided in a surface cleaning head 110. An upflow duct 112 extends upwardly from the surface cleaning head, downstream of the dirt inlet 102, and is in communication with a flexible hose 114. A cleaning unit 116 is mounted to the upflow duct 112, and includes the suction motor 106 and the treatment member 108. The hose 114 is in communication with the treatment member 108, and the suction motor 106 is downstream of and in communication with the treatment member 108. The clean air outlet 104 is downstream of the suction motor 106. A handle unit 115 is mounted to the upflow duct 112.

Referring still to FIG. 1, the fluid flow path comprises a portion 118 that has a bend (the portion 118 may also referred to herein as bend 118). In the example shown, the bend 118 is provided between the hose 114 and the cleaning unit 116. In alternate examples, the bend 118 may be provided elsewhere in the fluid flow path, for example between the upflow duct 112 and the hose 114, between the surface cleaning head 110 and the upflow duct 112, or may be a portion of the upflow duct 112 itself.

Figure 4:
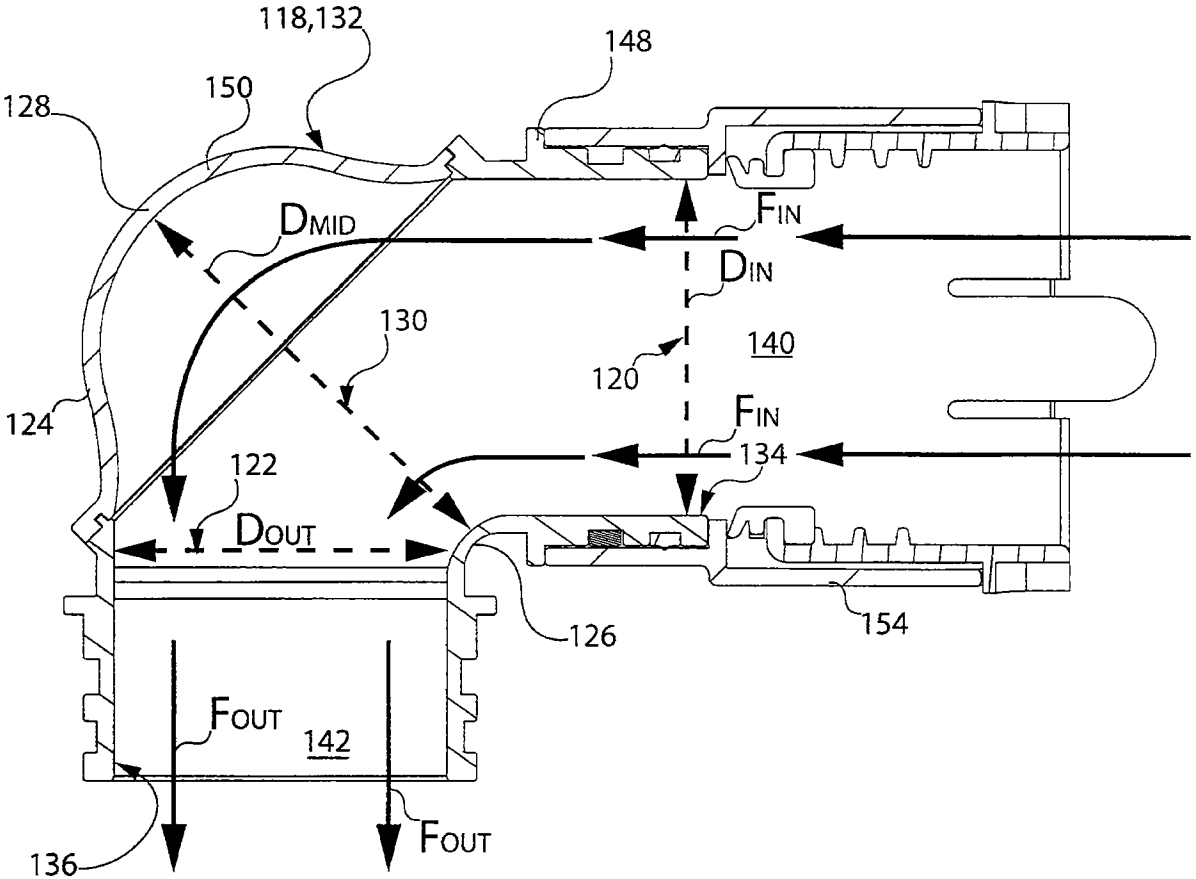
FIG. 4 is a cross section taken along line 4-4 in FIG. 2.
Figure 5:
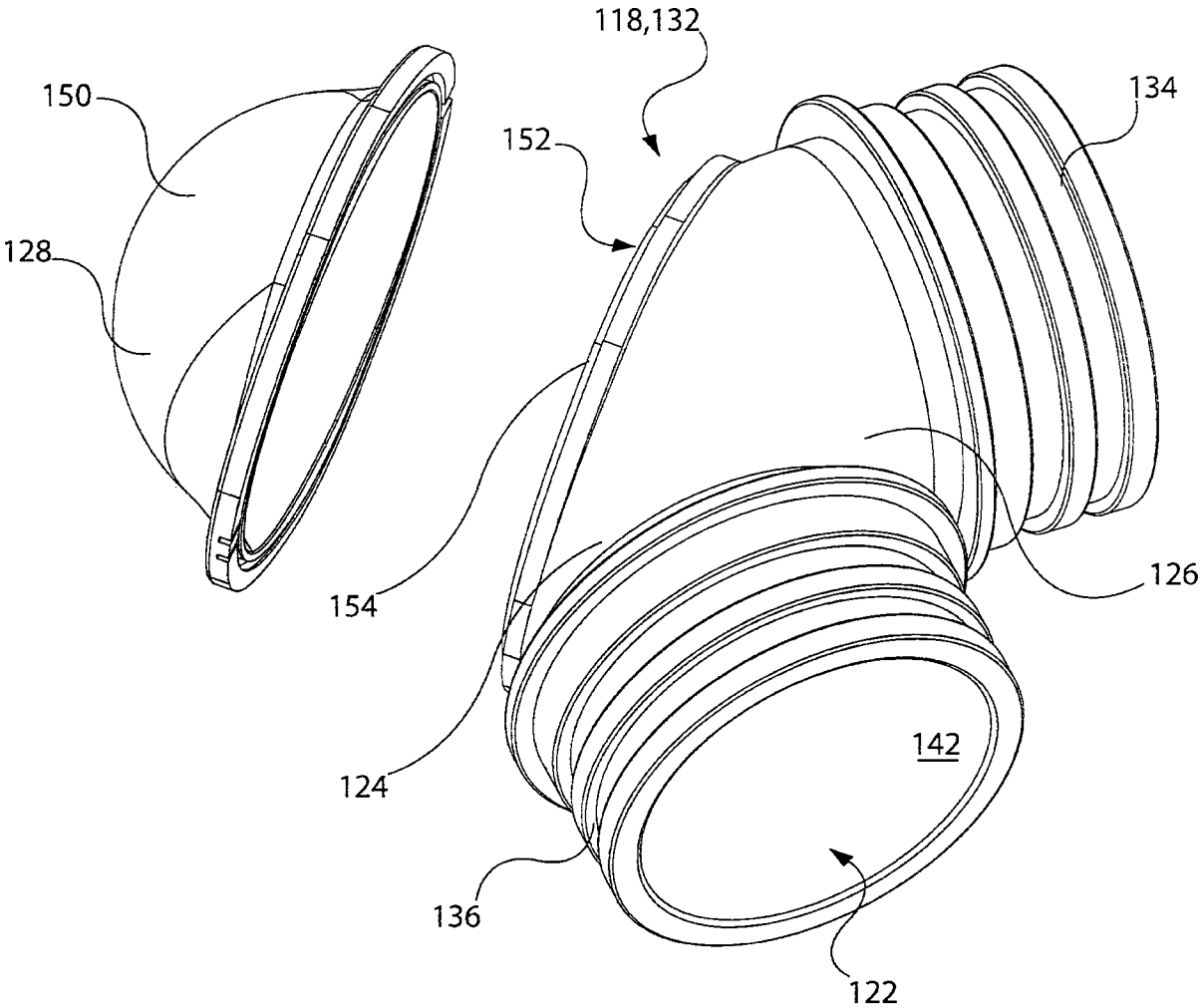
FIG. 5 is an exploded view of the bend of FIG. 1.

Referring now to FIGS. 2 to 5, and most particularly to FIG. 4, the bend 118 has a bend inlet 120 having an inlet direction of flow $F_{IN}$, a bend outlet 122 having an outlet direction of flow $F_{OUT}$. As shown, the bend is 90° ' and accordingly the inlet direction of flow $F_{IN}$ is at an angle of 90° with respect to the outlet direction of flow $F_{OUT}$. In alternate examples, the bend may be any angle that is of at least 45°.

Preferably, as exemplified, the inlet direction of flow $F_{IN}$ and the outlet direction of flow $F_{OUT}$ are in the same plane. That is, preferably, the bend 118 comprises only a two dimensional curve.

In the example shown, a wall 124 defines the bend, and extends between the bend inlet 120 and the bend outlet 122. The wall 124 comprises an inner wall 126, and an outer wall 128. In the example shown, the outer wall 128 is a curved outer wall. Further, the inner wall 126 is preferably a curved inner wall. That is, as shown, the outer wall 126 and the inner wall 128 are absent any sharp corners. The outer wall 128 is longer than the inner wall 126.

In the example shown, the outer wall 124 is formed by first part 148 and second part 150, as will be described further hereinbelow.

The bend 118 is configured to reduce, prevent, or minimize the occurrence of clogging therein. Specifically, all portions of the fluid flow path through the bend 118 have a cross sectional area (i.e. cross sectional area in a plane perpendicular to the direction of flow at that portion) that is at least about the same as a cross sectional area of the inlet 120. By providing the fluid flow path through the bend 118 with a cross sectional area that is at least about the same as a cross sectional area of the inlet 120, the occurrence of clogging within the bend 118 is prevented, reduced, or minimized.

For example, as shown, within the bend 118, all portions of the fluid flow path through the bend 118 have a cross sectional area that is greater than the cross sectional area of the inlet 120. More specifically, the inlet 120 is generally circular, and has a diameter $D_{IN}$, which defines the cross sectional area of the inlet 120. From the inlet 120, the cross sectional area increases gradually towards the midpoint 130 of the bend 118, and decreases gradually from the midpoint 130 towards the outlet 122. Accordingly, the inlet and outlet diameter are the same such that the all portions of the fluid flow path through the bend 118 have a cross sectional area that at least as large as the cross sectional area of the inlet 120. However, within the bend 118 (i.e. downstream of the inlet and upstream of the outlet), at all portions, the cross sectional area is greater than the cross sectional area at the inlet 120. For example, at the midpoint 130 of the bend 118, the bend 118 has a diameter $D_{MID}$, which is greater than $D_{IN}$, and which defines the cross sectional area at the midpoint 130. As $D_{MID}$ is greater than $D_{IN}$, the cross sectional area at the midpoint 130 of the bend 118 is greater than the cross sectional area at the inlet 120.

In alternate examples, all portions of the fluid flow path through the bend 118 may have a cross sectional area that is the same as the cross sectional area of the inlet 120. That is, the bend 118 may have a constant cross sectional area therethrough. In further alternate examples, some portions of the fluid flow path through the bend 118 may have a cross sectional area that is the same as the cross sectional area of the inlet 120, and some portions of the fluid flow path through the bend 118 may have a cross sectional area that is greater than the cross sectional area of the inlet 120. In further alternate examples, some or all portions of the bend 118 may have a cross sectional area that is slightly less than the cross sectional area of the inlet 120 (i.e. as used herein, the phrase "about the same" includes "slightly less than"). For example, all portions or some portions of the fluid flow path through the bend 118 may have a cross sectional area that is at least 90% and preferably at least 95% of the cross sectional area of the fluid flow path at the inlet 120.

Referring still to FIGS. 2 to 5, and most particularly to FIG. 4, in the example shown, the bend 118 is an elbow 132. As exemplified, the elbow 132 is adapted to be connected to other parts of the fluid flow path and may therefore have an upstream end 134 and/or a downstream end 136. As exemplified, the upstream end 134 is mounted to a coupling 154 of the hose 114, and the downstream end 136 is mounted to a connector 138, which is in communication with the treatment member 108. The upstream end 134 of the elbow 132 defines an inlet passage 140, which is in communication with the inlet 120 of the bend 118. The downstream end 136 of the elbow 132 defines an outlet passage 142, which is in communication with the outlet 122 of the bend 118. Upstream and downstream ends 134,136 preferably have a diameter that is at least the same as the diameter of inlet and outlet 120, 122.

As mentioned hereinabove, the bend 118 is preferably constructed from at least a first part 148 and a second part 150. More specifically, the wall 124 of the bend 118 is preferably constructed from at least a first part 148 and a second part 150. For example, as shown, the elbow 132 comprises a first part 148, which defines the inlet passage 140, the bend inlet 120, the inner wall 126, the outlet 122, and the outlet passage 142. An aperture 152 (shown in FIG. 5) is provided in the first part 148, at the outer side of the elbow 132, between the inlet 120 and the outlet 122. The second part 150 is mountable to the aperture 152. Accordingly, the outer side comprises the second part 150. The second part 150 comprises at least part of the curved outer wall.

The second part may optionally be removably mounted to the first part, or movably mounted to the elbow. For example, the outer part may be removably snapably mounted to the elbow, or pivotally mounted to the elbow (e.g., by a pivot pin) or screws or the like. In such embodiments, the aperture 152 may serve as a clean-out port, such that a user may remove any blockages in the bend 118 through the aperture 152. Alternately, the second part 150 may be permanently or semi-permanently mounted to the first part 148. For example, the second 150 parts may be adhered to the first part 148 by welding, an adhesive or the like.

In alternate examples, the bend may be constructed from more than two parts.

Preferably, the bend is fabricated by molding. For example, the first part 148 may be integrally molded, and the second part 150 may be integrally molded. More preferably, the bend 118 is fabricated from a molded plastic.

Accordingly, the bend may be prepared by molding the first part and separately molding the second part. The first and second parts may then be connected along abutting faces, e.g., flanges 154 and 156.

Although the invention has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention

The invention claimed is:

1. A domestic air treatment apparatus comprising:

(a) a fluid flow path including a dirt inlet and a clean air outlet;

(b) a suction motor and a treatment member provided in the flow path; and, (c) the fluid flow path comprising a portion that has a bend of at least 45°, the bend having a bend inlet having an inlet direction of flow, a bend outlet having an outlet direction of flow, and a medial portion between the bend inlet and the bend outlet, and a curved outer wall;

(d) whereby the fluid flow path through the bend has a cross sectional area and the cross sectional area increases from the bend inlet towards a midpoint of the bend, and decreases from the midpoint to the bend outlet, wherein the curved outer wall defines an outer radial side of the bend inlet, an outer radial side of the medial portion, and an outer radial side of the bend outlet, and wherein a portion of the outer radial side of the medial portion is radially outwardly positioned from a line defined by the outer radial side of the bend inlet and a portion of the outer radial side of the medial portion is radially outwardly positioned from a line defined by the outer radial side of the bend outlet.

2. The domestic air treatment apparatus of claim 1 wherein the inlet direction of flow and the outlet direction of flow are in the same plane.

3. The surface cleaning apparatus of claim 1 wherein all portions of the fluid flow path through the bend have a cross sectional area that is at least 90% of the cross sectional area of the inlet.

4. The domestic air treatment apparatus of claim 1 wherein the bend is constructed from at least a first part and a second part, wherein the first part comprises the bend inlet and the bend outlet and the second part comprises at least part of the curved outer wall.

5. The domestic air treatment apparatus of claim 1 wherein the bend is an elbow.

6. The domestic air treatment apparatus of claim 5 wherein the elbow has an inner side extending between the bend inlet and the bend outlet and an opposed outer side extending between the bend inlet and the bend outlet, the outer side being longer than the inner side, wherein at least a portion of the outer side comprises a second part.

7. The domestic air treatment apparatus of claim 6 wherein the second part is moveably mounted to the first part.

8. The domestic air treatment apparatus of claim 6 wherein the second part is removeably mounted to the first part.

9. The domestic air treatment apparatus of claim 4 wherein the outlet direction of flow is at about 90° to the inlet direction of flow.

10. The domestic air treatment apparatus of claim 1 wherein the bend is constructed from two parts.

11. The domestic air treatment apparatus of claim 1 wherein the bend has a curved inner wall.

12. The domestic air treatment apparatus of claim 1 wherein the domestic air treatment apparatus is a surface cleaning apparatus.

13. The domestic air treatment apparatus of claim 1 wherein the domestic air treatment apparatus is an air cleaner.

14. The domestic air treatment apparatus of claim 1 wherein the cross sectional area increases continuously from the bend inlet towards a midpoint of the bend, and decreases continuously from the midpoint to the bend outlet.

* * * * *